US011772394B2

(12) United States Patent
Yoshigai

(10) Patent No.: US 11,772,394 B2
(45) Date of Patent: Oct. 3, 2023

(54) LIQUID DISCHARGE APPARATUS AND LIQUID DISCHARGE METHOD

(71) Applicant: Shigeru Yoshigai, Kanagawa (JP)

(72) Inventor: Shigeru Yoshigai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/809,370

(22) Filed: Jun. 28, 2022

(65) Prior Publication Data

US 2023/0044459 A1 Feb. 9, 2023

(30) Foreign Application Priority Data

Aug. 5, 2021 (JP) ..... 2021-129053

(51) Int. Cl.

| | |
|---|---|
| ***B41J 3/407*** | (2006.01) |
| ***B41J 25/308*** | (2006.01) |
| ***B41J 29/393*** | (2006.01) |
| ***B41J 11/04*** | (2006.01) |
| ***B41J 11/00*** | (2006.01) |

(Continued)

(52) U.S. Cl.

CPC ..... *B41J 25/308* (2013.01); *B41J 11/0095* (2013.01); *B41J 11/04* (2013.01); *B41J 11/20* (2013.01); *B41J 29/42* (2013.01); *B41J 3/4078* (2013.01)

(58) Field of Classification Search

CPC ..... B41J 25/308; B41J 11/0095; B41J 11/04; B41J 11/20; B41J 29/42; B41J 3/4078; B41J 29/38; B41J 29/393

See application file for complete search history.

(56) References Cited

U.S. PATENT DOCUMENTS

2005/0068358 A1* 3/2005 Mizutani ..... B41J 3/4078 347/14
2009/0056582 A1* 3/2009 Mizutani ..... B41J 3/4078 101/484

(Continued)

FOREIGN PATENT DOCUMENTS

JP 2003-095482 4/2003
JP 2006-018463 1/2006

(Continued)

OTHER PUBLICATIONS

Kayanaka, MachineTranslationofJP-2007216502-A, 2007 (Year: 2007).*

*Primary Examiner* — Scott A Richmond
(74) *Attorney, Agent, or Firm* — IPUSA, PLLC

(57) ABSTRACT

A liquid discharge apparatus includes a platen to hold a medium; a liquid discharge head to discharge a liquid onto the medium on the platen according to discharge instruction information containing a type of the platen as a designated platen type; an operation panel to display a selection operation screen in which a type of the platen is selectable from the multiple platen types as a selected platen type; and circuitry to: control the operation panel to display the selection operation screen; determine whether the selected platen type matches a first specific platen type; determine whether the designated platen type matches a second specific platen type; control the operation panel to display warning in response to a determination; and control the liquid discharge head to continue to discharge the liquid in response to a determination.

11 Claims, 6 Drawing Sheets

(51) Int. Cl.
*B41J 29/42* (2006.01)
*B41J 11/20* (2006.01)

(56) References Cited

U.S. PATENT DOCUMENTS

| | | | |
|---|---|---|---|
| 2016/0067989 | A1 | 3/2016 | Yoshigai et al. |
| 2017/0015112 | A1 | 1/2017 | Yoshigai |
| 2019/0289161 | A1 | 9/2019 | Yoshigai |

FOREIGN PATENT DOCUMENTS

| | | | | | |
|---|---|---|---|---|---|
| JP | 2007216502 | A | * | 8/2007 | ..... B41J 11/06 |
| JP | 2009-051114 | | | 3/2009 | |
| JP | 2020-026044 | | | 2/2020 | |

* cited by examiner

LIQUID DISCHARGE APPARATUS AND LIQUID DISCHARGE METHOD

CROSS-REFERENCE TO RELATED APPLICATIONS

This patent application is based on and claims priority pursuant to 35 U.S.C. § 119(a) to Japanese Patent Application No. 2021-129053, filed on Aug. 5, 2021, in the Japan Patent Office, the entire disclosure of which is incorporated by reference herein.

BACKGROUND

Technical Field

Embodiments of this disclosure relate to a liquid discharge apparatus and a liquid discharge method.

Related Art

The liquid discharge apparatus discharges a liquid to a medium to form an image according to an image forming instruction from, for example, an information processing apparatus. The liquid discharge apparatus is referred to as an inkjet printer including a liquid discharge head that discharge a liquid to a medium. In recent years, an inkjet printer that treats a fabric such as clothing as medium is known. Such a printer is referred to as a direct to garment printer (DGT printer).

SUMMARY

A liquid discharge apparatus includes a platen to hold a medium; a liquid discharge head to discharge a liquid onto the medium on the platen according to discharge instruction information containing information of a type of the platen designated from multiple platen types as a designated platen type; an operation panel to display a selection operation screen in which a type of the platen is selectable from the multiple platen types as a selected platen type; and circuitry to: control the operation panel to display the selection operation screen on the operation panel; determine whether the selected platen type matches a first specific platen type among the multiple platen types; determine whether the designated platen type matches a second specific platen type different from the first specific platen type among the multiple platen types; control the operation panel to display warning in response to a determination in which: the selected platen type matches the first specific platen type, and the designated platen type matches the second specific platen type; and control the liquid discharge head to continue to discharge the liquid in response to a determination in which: the selected platen type matches the first specific platen type, and the designated platen type matches the second specific platen type.

A liquid discharge method includes: holding a medium on a platen; discharging a liquid onto the medium on the platen according to discharge instruction information containing information of a type of the platen designated from multiple platen types as a designated platen type; displaying a selection operation screen, on an operation panel, in which the type of the platen is selectable from the multiple platen types as a selected platen type; and controlling the operation panel to display the selection operation screen on the operation panel; determining whether the selected platen type matches a first specific platen type among the multiple platen types; determining whether the designated platen type matches a second specific platen type different from the first specific platen type among the multiple platen types; controlling the operation panel to display warning in response to a determination in which: the selected platen type matches the first specific platen type, and the designated platen type matches the second specific platen type; and controlling a liquid discharge head to continue to discharge the liquid in response to a determination in which: the selected platen type matches the first specific platen type, and the designated platen type does not match the second specific platen type.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
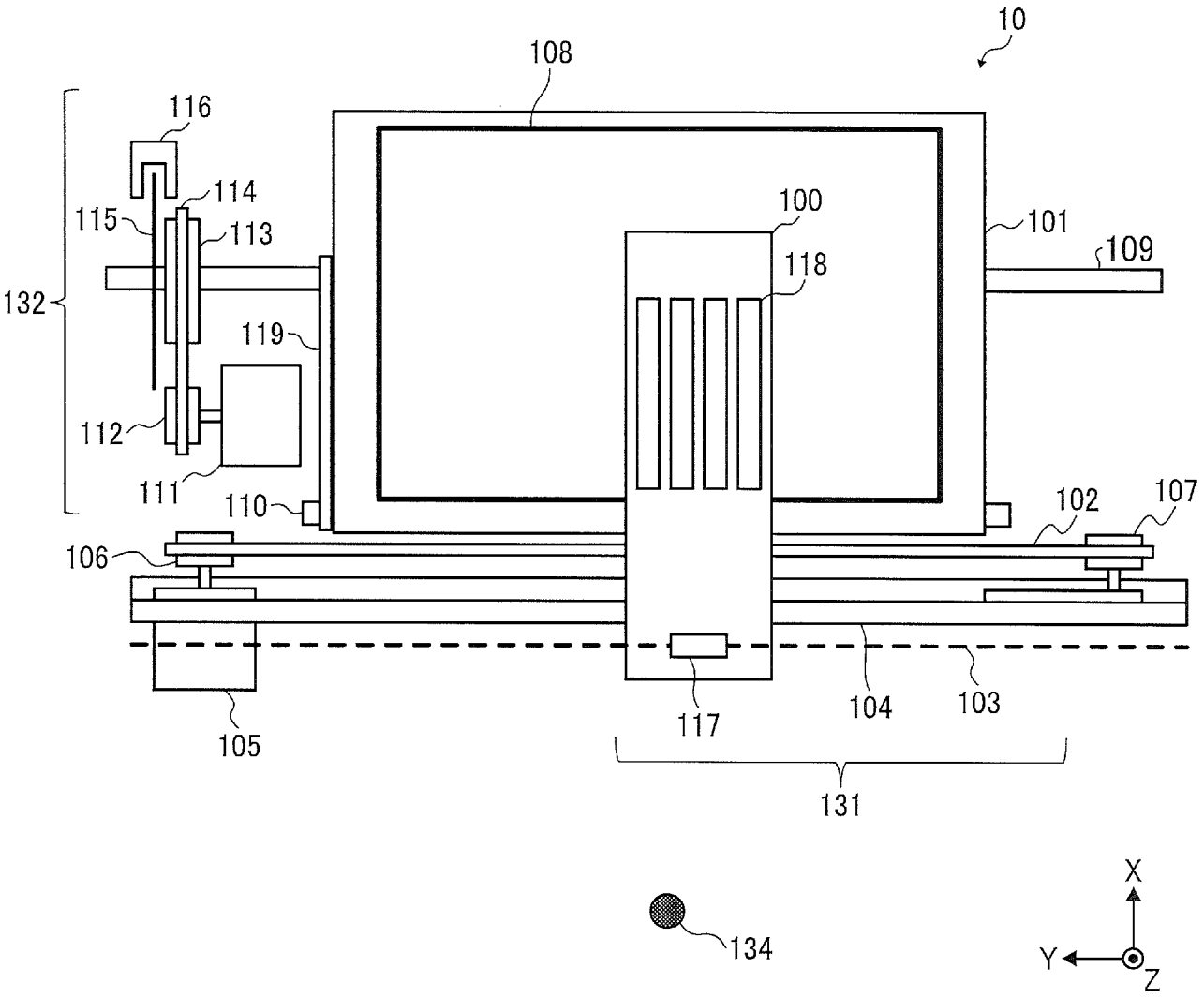
FIG. 1 is a schematic plan view of a main portion of an internal structure of a liquid discharge apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise.

Embodiments of the present disclosure provide a liquid discharge apparatus (inkjet printer) that can avoid troubles or difficulties ahead.

Hereinafter, an inkjet printer 10 as an embodiment of a liquid discharge apparatus according to the present disclosure will be described with reference to the drawings.

Outline of Inkjet Printer As illustrated in FIG. 1, the inkjet printer 10 holds a carriage 100 as with a slide rail 104 formed together with a sheet metal. The main-scanning motor 105 reciprocally moves the carriage 100 in the main scanning direction via the timing belt 102 bridged between a driving pulley 106 and a driven pulley 107. In the present specification, the main scanning direction corresponds to the Y-direction illustrated in FIGS. 1 and 2.

The carriage 100 mounts liquid discharge heads 118 including four liquid discharge heads that discharge liquids (i.e., ink) of respective colors of black (K), yellow (Y), magenta (M), and cyan (C). Each liquid discharge head 118 includes a nozzle array including multiple nozzles arrayed in a row in a sub-scanning direction perpendicular to the main scanning direction. The nozzle array faces to a platen 101 (conveyor platen), which is downward. In the present specification, the sub-scanning direction corresponds to the X-direction illustrated in FIGS. 1 and 2.

As the liquid discharge head 118 mounted on the carriage 100, the liquid discharge head having multiple nozzle rows for discharging ink droplets of respective colors is exemplified, but the configuration of the liquid discharge head 118 applicable to the inkjet printer 10 is not limited thereto. For example, the liquid discharge head 118 that independently corresponds to ink droplets of each color can be used. In addition, the number of colors applied as ink droplets and the arrangement order of the liquid discharge heads 118 are not limited thereto.

The liquid discharge head 118 may include a pressure generator that generates the pressure to discharge liquid droplets. The pressure generator is, for example, a piezoelectric actuator such as a piezoelectric element, a thermal actuator using phase change by film boiling of liquid using an electrothermal conversion element such as a heating resistor. In addition to such actuators, a shape-memory alloy actuator using a metal phase change due to a temperature change and an electrostatic actuator using an electrostatic force may be used as the pressure generator. Any one of the above-described configurations of the pressure generator may be applied as long as ink droplets of a designated color can be discharged in a designated amount at a discharge timing instructed from the outside.

The inkjet printer 10 includes an encoder scale 103 formed with slits along the main-scanning direction. The carriage 100 includes an encoder sensor 117 to detect the slits of the encoder scale 103. The encoder sensor 117 and the encoder scale 103 configure a linear encoder 131 that detects the position of the carriage 100 in the main-scanning direction.

The inkjet printer 10 also includes the platen 101 (conveyance platen) as a medium holder that holds the medium 108 (recording medium). The platen 101 reciprocally moves in the sub-scanning direction by the conveyance mechanism (conveyer) while holding the medium 108 (recording medium). At this time, the platen 101 reciprocally moves the medium 108 at a position facing the liquid discharge head 118.

The medium 108 may be of any type as long as it is held and conveyed by the platen 101. Thus, for example, the medium 108 may be a fabric such as clothing.

The platen 101 moves in the sub-scanning direction (X-direction) using a sub-scanning motor 111 configuring a conveyance mechanism (conveyor) as a driving source. A timing belt 114 is bridged between a conveyance drive pulley 112 provided on a rotation shaft of the sub-scanning motor 111 and a conveyance roller pulley 113 provided at a position separated from the conveyance drive pulley. A conveyance roller 109 is connected to a rotation shaft of the conveyance roller pulley 113. The inkjet printer 10 includes a sub-scanning motor 111 that rotates the conveyance roller 109 to move the platen 101.

Further, the inkjet printer 10 is provided with an encoder wheel 115 in which a slit is faulted coaxially with the conveyance roller 109. The inkjet printer 10 includes an encoder sensor 116 that detects the slits of the encoder wheel 115. The encoder sensor 116 is provided on a side plate of a part of the housing of the inkjet printer 10. These components constitute a wheel encoder 132 for detecting the position of the platen 101 in the sub-scanning direction.

The platen 101 is a flatbed type and is conveyed horizontally in the sub-scanning direction via a timing belt 119 bridged between a conveyance roller 109 and a tension roller 110.

Figure 2:
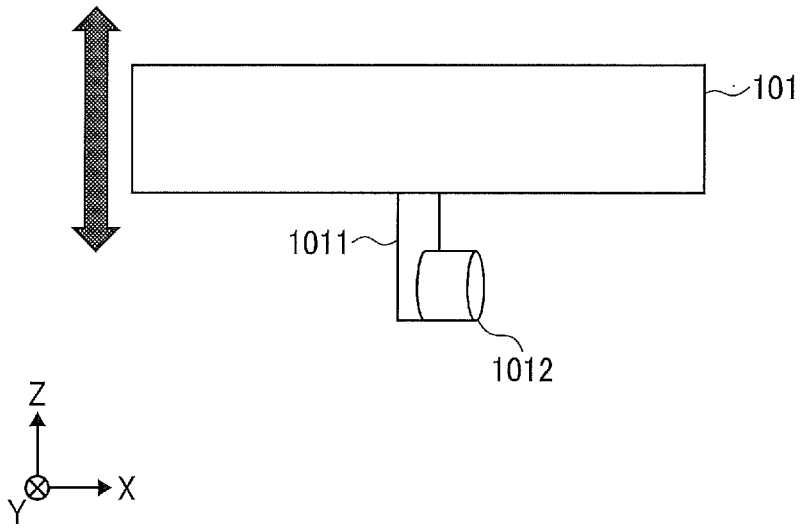
FIG. 2 is a schematic diagram of an elevation mechanism of a platen according to the embodiment of the present disclosure.

FIG. 2 is a schematic diagram of an elevation mechanism to adjust the height of the platen 101. The height of the platen 101 corresponds to the position of the uppermost surface of the platen 101 in the Z-direction. The quality of image formation can be maintained or improved by adjusting the distance (gap) between the ink discharge ports (nozzles) on the lower surface of the liquid discharge head 118 and the upper surface of the platen 101 to an optimum value. Thus, the position of the platen 101 in the Z-direction is adjusted precisely.

Various types of the platen 101 can be selected, and there are differences in dimensions and shapes in the conveyance direction according to the type. The user can select any platen 101 according to the type of the medium 108 and mount the selected platen 101 on the inkjet printer 10.

The platen 101 is mounted on the inkjet printer 10, and the gap (height) is adjusted by a gap adjuster as illustrated in FIG. 2. The gap adjuster includes a gear 1011 to move the platen 101 in the vertical direction (Z-direction), and a platen elevating motor 1012 to move the gear 1011 in the vertical direction. With the rotation of the platen elevating motor 1012 rotates, the gear 1011 moves in the vertical direction to be held at any position in the vertical direction of the platen 101.

When adjusting the gap between the liquid discharge ports of the liquid discharge head 118 and the platen 101, the gap sensor 134 illustrated in FIG. 1 measures the distance to the upper surface of the platen 101, and the platen elevating motor 1012 is moved so that the distance reaches a predetermined value (distance). At this time, the measurement position on the upper surface of the platen 101 differs depending on the type of the platen 101. For example, the gap is measured and set after the movement of the platen 101 in the sub-scanning direction so that the gap can be measured at the most suitable position according to the size and shape of the platen 101.

In the present specification, the gap between the upper surface of the platen 101 and the discharge port configured by the ink discharge ports also corresponds to the height of the platen 101. Thus, the gap adjustment may be referred to as height adjustment.

An image forming operation may be executed in the inkjet printer 10 without setting a specific type of the platen 101. In this case, the gap adjustment of the platen is executed based on the height of the center position of the platen 101 in the sub-scanning direction.

The liquid discharge apparatus further includes a gap adjuster to adjust a gap between the liquid discharge head and the platen. The circuitry stops discharging the liquid until the gap adjuster adjusts the gap.

Figure 3:
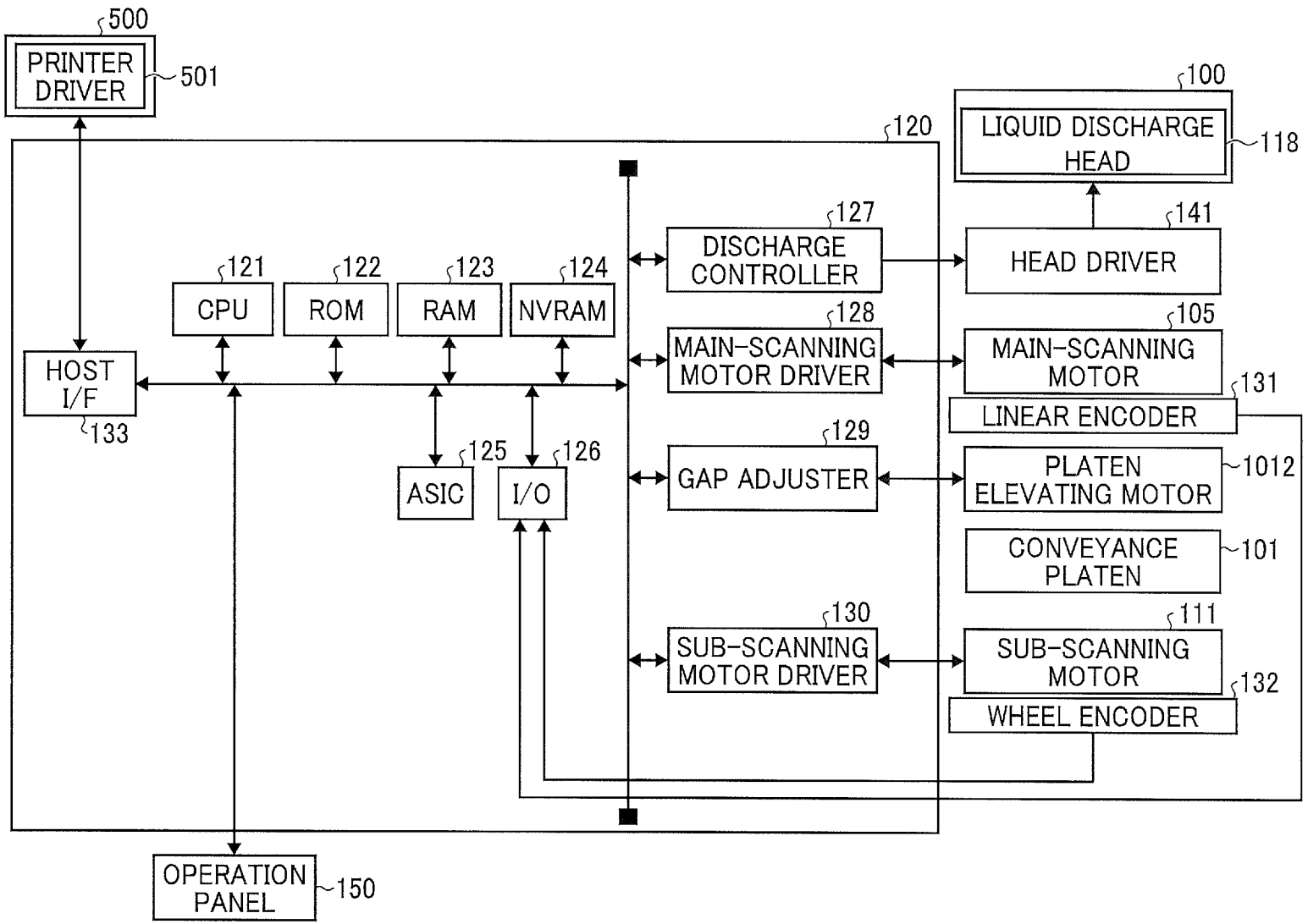
FIG. 3 is a schematic block diagram of circuitry according to the embodiment of the present disclosure.

Configuration of Control Block A configuration of a control block included in the inkjet printer 10 according to the present embodiment will be described with reference to FIG. 3. As illustrated in FIG. 3, the controller 120 of the inkjet printer 10 includes a central processing unit (CPU)

121, a read only memory 122 (ROM), a random access memory 123 (RAM), a non-volatile random access memory 124 (NVRAM), and an application specific integrated circuit 125 (ASIC). The controller 120 serves as circuitry to control the inkjet printer 10.

The CPU 121 is connected to an operation panel 150 as a display-operation unit for inputting and displaying information (e.g., platen type) for the inkjet printer 10, and controls the entire operation of the inkjet printer 10. The CPU 121 also has functions of controlling the conveyance operation (i.e., movement in the sub-scanning direction) of the platen 101, the movement operation of the carriage 100 in the main scanning direction, and the liquid discharge operation of the liquid discharge head 118.

The ROM 122 is a non-volatile storage media that stores programs to be executed by the CPU 121 and other fixed information. The program stored in the ROM 122 is executed by the arithmetic processing function of CPU 121. Thus, the CPU 121 and the ROM 122 form a program controller described below.

The RAM 123 temporarily stores, for example, image information used for image forming processing. The RAM 123 functions as a work area when the program control unit is executed.

The NVRAM 124 is a rewritable non-volatile recording medium for storing information while the power supply to the inkjet printer 10 is shut off.

The ASIC 125 processes input and output signals for controlling the entire apparatus. The controller 120 includes a host interface 133 (I/F), a discharge controller 127, a main-scanning motor driver 128, a gap adjuster 129, a sub-scanning motor driver 130, and an input-and-output (I/O) unit 126.

The host I/F 133 serves to transmit and receive data and control signals to and from a host, such as a printer driver 501 of an external apparatus 500.

The discharge controller 127 generates a drive waveform for driving the liquid discharge head 118 and outputs image data for selectively driving a pressure generator of the liquid discharge head 118 and various data associated with the image data to the head driver 141.

The main-scanning motor driver 128 drives the main-scanning motor 105.

The gap adjuster 129 instructs the platen elevating motor 1012 that elevates the platen 101 to adjust the gap. The platen 101 is detected by, for example, an LED sensor to adjust the gap with the nozzle opening.

The sub-scanning motor driver 130 drives a sub-scanning motor 111 that moves the cassette 200 in the sub-scanning direction.

The I/O unit 126 inputs detection signals from various sensors to operate the inkjet printer 10.

In the controller 120, the host I/F 133 receives an image forming instruction to be used for an image forming process from the printer driver 501 of the external apparatus 500 via a cable or network. The printer driver 501 generates the image faulting instruction in an information processing apparatus such as a personal computer (PC), an image reading device such as an image scanner, or the external apparatus 500 having a host function such as an imager (e.g., a digital camera).

In the controller 120 receiving the print data as an image forming instruction, the CPU 121 reads out and analyzes the image forming instruction in a reception buffer included in the host I/F 133. According to an analyzing result of the CPU 121, the ASIC 125 performs desired image processing, for example, data rearrangement processing, and transfers a print data to the discharge controller 127. Thus, the discharge controller 127 outputs image data and a drive waveform to the head driver 141 at a predetermined timing. The dot pattern for image output may be generated by, for example, storing font information in a ROM 122, or the printer driver 501 may develop the image data into bitmap data and transfer to the inkjet printer 10 to generate the dot pattern data. Herein, the printer driver 501 performs the processing.

Thus, the image forming instruction corresponds to the discharge instruction information.

The drive waveform generator of the discharge controller 127 includes a digital-to-analog (D/A) converter and an amplifier for D/A conversion of pattern data of drive pulses stored in the ROM 122 and read by the CPU 121. The drive waveform generator of the discharge controller 127 outputs a drive waveform including one drive pulse or multiple drive pulses to the head driver 141. The head driver 141 drives the liquid discharge head 118 according to the image data (i.e., dot pattern data) corresponding to one line serially input into the liquid discharge head 118. The head driver 141 selectively applies drive pulses to the pressure generator of the liquid discharge head 118. The drive pulses include the drive waveform provided from the drive waveform generator of the discharge controller 127.

The head driver 141 includes, for example, a shift register to which a clock signal and serial data as image data are input, and a latch circuit that latches a resist value of the shift register with a latch signal. In addition, the head driver 141 includes, for example, a level conversion circuit (i.e., level shifter) that changes the level of the output value of the latch circuit and an analog switch array that is controlled to be turned on or turned off by the level shifter. Functionally, the head driver 141 controls turning ON or turning OFF of the analog switch array to selectively apply a desired drive pulse in the drive waveform to the pressure generator of the liquid discharge head 118.

The image forming instruction includes the type of the medium. The inkjet printer 10 according to the present embodiment can select and use the platen 101 in accordance with the type of the medium. Thus, the type of the medium included in the image forming instruction corresponds to the type of the platen 101 to be used.

Figure 5A:
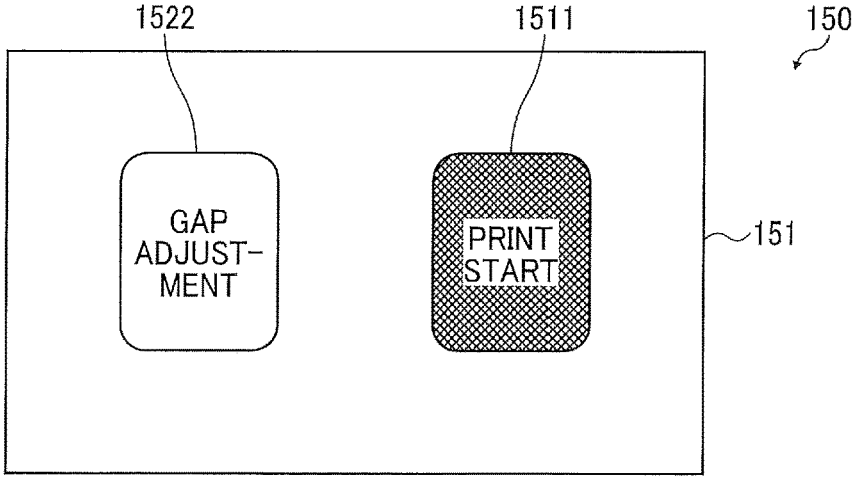
FIGS. 5A to 5C are illustrations of displays on an operation panel according to the embodiment of the present disclosure.
Figure 5B:
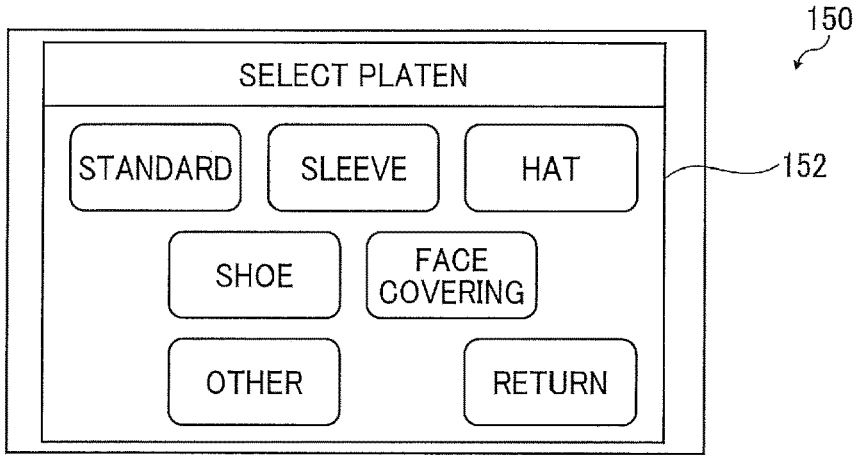

The types of the platen 101 that can be selected in the inkjet printer 10 according to the present embodiment are, for example, "STANDARD", "SHOE", "HAT", "SLEEVE", "FACE COVERING", and "OTHER" (FIG. 5B). In the present specification, the setting (type) of the platen 101 selected by the user in the inkjet printer 10 is referred to as a "printer platen setting". Further, the setting related to the type of the platen 101 included in the image forming instruction is referred to as "data platen setting".

When the user selects "OTHER" as the type of the platen 101 among the selectable types of platen 101, the image forming operation (i.e., printing operation) is executed irrespective of the setting related to the type of the platen (i.e., the data platen setting) included in the image forming instruction. In the inkjet printer 10, when the printer platen setting is "OTHER", the image forming operation is executed if the data platen setting and the printer platen setting do not match. When the printer platen setting is other than "OTHER", the inkjet printer 10 stops the image forming operation if the data platen setting and the printer platen setting do not match.

Processes of Image Forming Operation

The flowchart of the image forming operation of the inkjet printer 10 will be described with reference to FIGS. 4, 5A to 5C, and 6. When the image forming operation (i.e., printing operation) starts in a state where the platen 101 is selected and mounted on the inkjet printer 10 by the user, the inkjet printer 10 first executes a gap (i.e., height) adjustment of the platen 101 mounted on the inkjet printer 10. FIGS. 5A to 5C are examples of a screen for requesting the gap adjustment, which is a print instruction screen 151 displayed on the operation panel 150.

As illustrated in FIG. 5A, the print instruction screen 151 includes a print start button 1511 and a gap adjustment button 1522. When the user presses either of two buttons on the print instruction screen 151, the gap adjustment or the printing is correspondingly executed. The gap adjustment has not been executed yet when the user starts printing, the print start button 1511 is inoperable as illustrated in FIG. 5A. In FIG. 5A, the print start button 1511 is depicted in gray to express the inoperable state.

Preferably, the inkjet printer automatically and periodically executes the gap adjustment (at predetermined time interval, or at a certain time interval). A timer control may be used to execute the gap adjustment periodically. When the user starts printing, and the gap adjustment has not been done by the timer control, the print start button 1511 is inoperable as illustrated in FIG. 5A. If the gap adjustment is not completed at a start of the image forming operation (i.e., prating), the printing start button 1511 on the operation panel 150 is inoperable as illustrated in FIG. 5A as described above.

In the liquid discharge apparatus, circuitry stops discharging the liquid until the gap adjuster adjusts the gap at a certain time interval.

Figure 4:
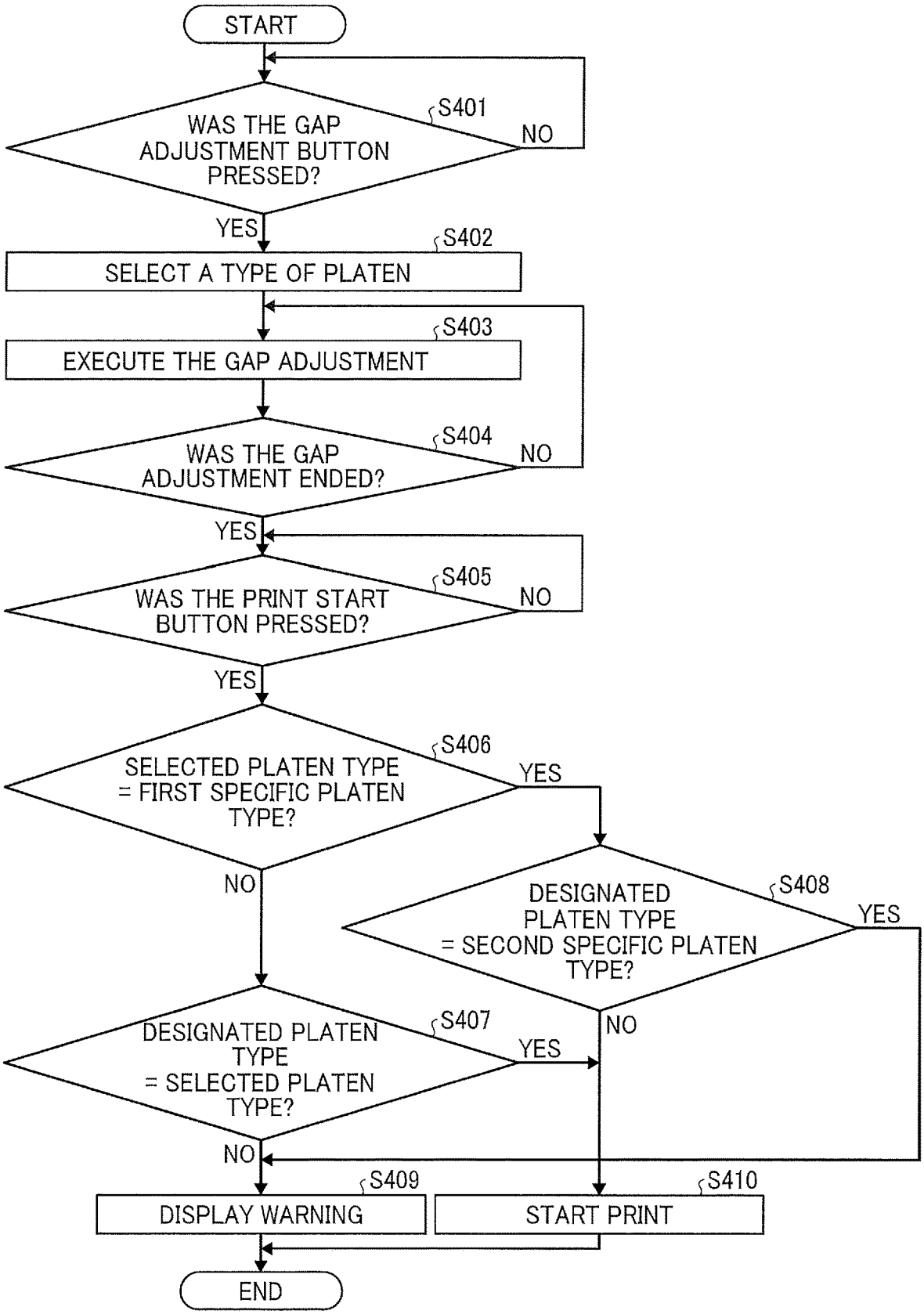
FIG. 4 is a flowchart of a printing process according to the embodiment of the present disclosure.
Figure 5C:
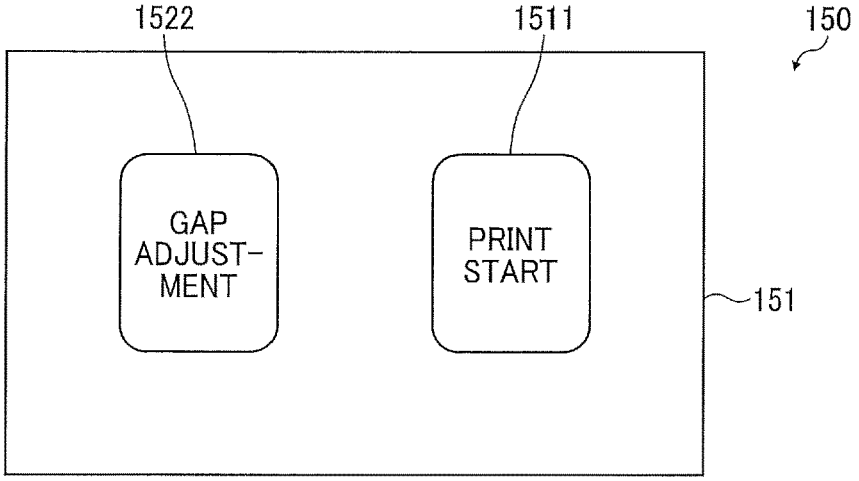

In FIG. 4, the process in S401 does not end (is repeated) until the gap adjustment button 1522 is pressed (S401: NO). When the gap adjustment is still to be executed, the inkjet printer 10 does not execute the image forming operation. In other words, the gap adjustment is to be executed by the user before the image forming operation of the inkjet printer 10.

When the gap adjustment button 1522 is pressed in S401 (YES in S401), the operation panel 150 displays a platen selection screen 152 that allows the user to select the type of the platen 101 mounted on the inkjet printer 10 in step S402. FIG. 5B is an example of the platen selection screen 152. The type of the platen 101 selected in S402 is stored in a storage area of the controller 120 as a "selected platen type".

The type of the platen 101 is selected in S402. In FIG. 5B, when the "RETURN" button is pressed, the gap adjustment is executed (S403). In S403, the gap adjuster 129 operates the platen elevating motor 1012 while measuring the gap between the platen 101 and the liquid discharge head, and the gap adjustment (S403) is repeated until the position of the platen 101 reaches a predetermined position (S404: NO).

When the gap adjustment is ended (S404: YES), the position of the platen 101 is adjusted so as to form an appropriate gap. The print instruction screen 151 is displayed again, and the print start button 1511 turns operable as illustrated in FIG. 5C.

The inkjet printer 10 may receive an image forming instruction from the external apparatus 500 at any timing from S401 to S404, at which the gap adjustment of the platen 101 is executed. In the inkjet printer 10, the type of the platen 101 included in the image forming instruction is stored and held as a "designated platen type" in a storage part in the controller 120.

As illustrated in FIG. 5C, when the print start button 1511 is operable and pressed (S405: YES), the type of the platen is determined. The inkjet printer 10 determines whether the selected platen type of the platen 101 stored as the selected platen type is "OTHER" as "a first specific platen type (specific selected type information)" or not (S406). If the selected platen type is "OTHER" (S406: YES), and if the type of the platen 101 mounted on the inkjet printer 10 does not match the type of the platen 101 of the "designated platen type", the printing operation continues without stopping.

In the liquid discharge apparatus, the circuitry determines whether the selected platen type matches the designated platen type in response to a determination in which the selected platen type does not match the first specific platen type, and the circuitry does not determine whether the selected platen type matches the designated platen type in response to a determination in which the selected platen type matches the first specific platen type. As described above, when the user selects "OTHER" as the selected platen type for the platen 101 mounted on the inkjet printer 10 and selects continuation of liquid discharge according to the image forming instruction, the printing flows continue without stopping while changing various types of platen 101. Thus, if the type of the platen 101 mounted on the inkjet printer does not match the type of the platen 101 designated by the image forming instruction, the liquid discharge continues according to the image forming instruction. If the selected platen type and the designated platen type do not match and the printing operations stops, it is inconvenient for the user. However, in the present embodiment, if the selected platen type and the designated platen type do not match, the printing operation can continue. Depending on the quality of the printing result, user convenience improves.

Although the user selects "OTHER" as the selected platen type of the platen 101 mounted on the inkjet printer 10 to continue the printing operation, an operation failure may occur irrespective of the absence of the operation failure at a certain point during the printing operation. The inkjet printer 10 determines whether the unexpected error for the user may occur or not, and temporarily provides the user to determine whether the printing operation continues or not. Irrespective of the type of the platen 101, in response to receiving the image forming instruction that allows continuation of the printing operation, the inkjet printer 10 continues the print operation. If the image forming instruction including the specific data platen setting (i.e., designated platen type) is received, the inkjet printer prompts the user to determine whether to continue the printing operation.

In the present embodiment, if the selected platen type is "OTHER" (i.e., second specific platen type, or specific designated type information), the printing operation is not continued unconditionally. The inkjet printer 10 determines the content of the designated platen type (S408). In response to a determination that the designated platen type is "FACE COVERING" as the second specific platen type (YES in S408, the inkjet printer 10 displays a warning screen 153, as illustrated in FIG. 6, on the operation panel 150 (S409).

Figure 6:
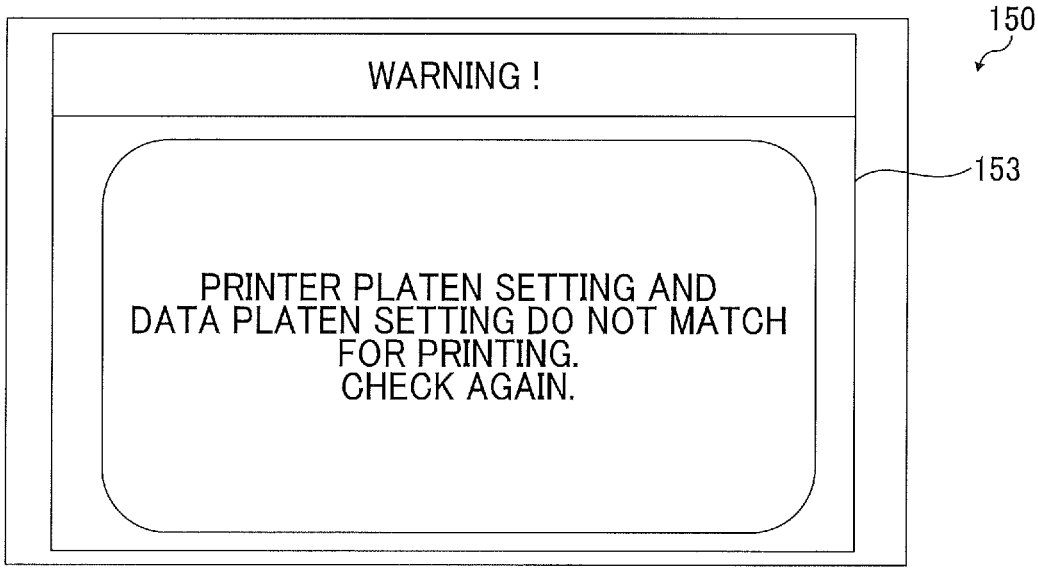
FIG. 6 is a diagram of a warning display displayed on the operation panel according to the embodiment of the present disclosure.

The warning screen 153 in FIG. 6 is an example of a screen that displays a warning message notifying the user that the printing operation is impossible to continue. An example of the warning message is "WARNING! PRINTER PLATEN SETTING AND DATA PLATEN SETTING DO NOT MATCH FOR PRINTING. CHECK AGAIN.". The warning message prompts the user to check the setting (i.e., print platen setting) of the platen 101 on the inkjet printer 10. In response to determining that a failure (i.e., an unexpected error for the user) is likely to occur, the inkjet printer 10 notifies the user who intends to intermittently continue printing operation, of the possibility of failure to discharge a liquid (i.e., the inkjet printer 10 clearly warns the user that the printer may not continue printing operation (e.g., liquid discharge)). If the user continues the printing operation under a specific condition: the selected platen type is "OTHER" and the designated platen type is "FACE COVERING", the quality of the printing result may not satisfy the user requirement. However, in the present embodiment, the inkjet printer 10 displays the warning screen 153 to prompt the user to redetermine to continue the printing operation. As a result, user convenience is improved. In other words, under such conditions, notifying the user to continue the printing operation to discharge a liquid, by the inkjet printer 10, enables a higher convenience for the user.

In S408, if the designated platen type does not match "FACE COVERING" (S408, NO), the printing (liquid discharge) is executed (S410).

A liquid discharge apparatus includes a platen 101 to hold a medium 108; a liquid discharge head 118 to discharge a liquid onto the medium 108 on the platen 101 according to discharge instruction information containing information of a type of the platen designated from multiple platen types as a designated platen type; an operation panel 150 to display a selection operation screen in which the type of the platen 101 is selectable from the multiple platen types as a selected platen type; and circuitry to: control the operation panel 150 to display the selection operation screen on the operation panel; determine whether the selected platen type matches a first specific platen type among the multiple platen types (S406); determine whether the designated platen type matches a second specific platen type different from the first specific platen type among the multiple platen types (S408); control the operation panel 150 to display warning (S409) in response to a determination in which: the selected platen type matches the first specific platen type (S406, YES), and the designated platen type matches the second specific platen type (S4078, YES); and control the liquid discharge head 118 to continue to discharge the liquid (S410) in response to a determination in which: the selected platen type matches the first specific platen type (S406, YES), and the designated platen type does not match the second specific platen type (S408, NO). A liquid discharge method includes holding a medium 108 on a platen 101; discharging a liquid onto the medium 108 on the platen 101 according to discharge instruction information containing information of a type of the platen designated from multiple platen types as a designated platen type; displaying a selection operation screen, on an operation panel 150, in which the type of the platen 101 is selectable from the multiple platen types as a selected platen type; and controlling the operation panel 150 to display the selection operation screen on the operation panel; determining whether the selected platen type matches a first specific platen type among the multiple platen types (S406); determining whether the designated platen type matches a second specific platen type different from the first specific platen type among the multiple platen types (S408); controlling the operation panel 150 to display warning (S409) in response to a determination in which: the selected platen type matches the first specific platen type (S406, YES), and the designated platen type matches the second specific platen type (S4078, YES); and controlling the liquid discharge head 118 to continue to discharge the liquid (S410) in response to a determination in which: the selected platen type matches the first specific platen type (S406, YES), and the designated platen type matches the second specific platen type (S408, NO).

As described above, in the inkjet printer 10, if the selected platen type does not match the designated platen type, and "OTHER", which is the platen type that enables the printing operation to continue without stopping, is selected as the selected platen type, the printing operation can continue.

If the selected platen type does not match the designated platen type, and the selected platen type is a specific platen type (e.g., FACE COVERING), the quality of the printing result may not satisfy the user requirement unless the gap adjustment of the platen 101 is executed again. In response to determining that such a failure to continue printing may occur, the inkjet printer 10 displays the warning screen 153 notifying the user of the possibility of an error (i.e., failure) and to check the type of the platen before the user continues to print. Accordingly, the user can avoid an unexpected error in advance and obtain a high-quality image. User convenience of the inkjet printer is improved.

In the liquid discharge apparatus, the circuitry controls the operation panel 150 to display warning (S409) in response to a determination in which: the selected platen type does not match the first specific platen type (S406, NO), and the designated platen type does not match the second specific platen type (S407, NO). In the liquid discharge apparatus, the circuitry controls the liquid discharge head 118 to continue to discharge the liquid (S410) in response to a determination in which: the selected platen type does not match the first specific platen type (S406, NO), and the designated platen type matches the second specific platen type (S407, YES).

The liquid discharge method further includes: controlling the operation panel 150 to display warning (S409) in response to a determination in which: the selected platen type does not match the first specific platen type (S406, NO), and the designated platen type does not match the second specific platen type (S407, NO).

In S406, if the selected platen type does not match "OTHER" as the first specific platen type (S406: NO), the inkjet printer 10 determines whether the designated platen type matches the selected platen type matches or not (S407). In S407, if the designated platen type matches the selected platen type (S407: YES), printing (liquid discharge) is executed (S410).

In S407, if the selected platen type does not match the designated platen type (S407: NO), the warning screen 153 as illustrated in FIG. 6 is displayed on the operation panel 150 (S409).

In the liquid discharge apparatus, the gap adjuster includes a sensor to detect the platen, and the sensor does not detect the platen in response to a determination in which the designated platen type matches the second specific platen type (S407, YES). The liquid discharge method further includes: controlling the liquid discharge head 118 to continue to discharge the liquid (S410) in response to a determination in which: the selected platen type does not match the first specific platen type (S406, NO), and the designated platen type matches the second specific platen type (S407, YES).

The liquid discharge method further includes: determining whether the selected platen type matches the designated platen type in response to a determination in which the selected platen type does not match the first specific platen type, and determining whether the selected platen type matches the designated platen type in response to a determination in which the selected platen type matches the first specific platen type.

Effects of the inkjet printer 10 according to the present embodiment described above will be described. The user can mount any type of the platen 101 on the inkjet printer 10. The image forming operation (printing operation) may be performed if the selected platen type of the mounted platen 101 does not match the designated platen type included in the image forming instruction input from the external apparatus 500. Thus, if the selected platen type and the designated platen type do not match each other, and the user desires to continue the printing operation, and if the first specific platen type that enables the printing operation to continue is selected as the selected platen type, the printing operation may continue without stopping.

However, if the user changes the type of the platen 101 at any timing, and if the platen 101 changed by the user is the second specific platen type, the gap adjustment may not be performed accurately in the periodically gap adjustment. In response to determining that a failure as described above (an unexpected error for the user) may occur, the inkjet printer 10 displays the warning screen 153 (the CPU 121 causes the operation panel 150 to display the warning screen 153) in advance before detecting the failure.

Accordingly, the warning screen 153 prompts the user to check the type of the platen 101 or to change the designated platen type. If the user starts the printing operation, and the printing operation is stopped by the detected an error in the middle of the printing operation, it is inconvenient for the user. However, in the present embodiment, the inkjet printer avoids such an error in advance. In addition, in the present embodiment, the printing operation of the inkjet printer 10 is easy to continue, the operation efficiency can be improved.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above.

Each of the functions of the described embodiments such as the controller 120 may be implemented by one or more processing circuits or circuitry. Processing circuitry includes a programmed processor, as a processor includes circuitry. A processing circuit also includes devices such as an application specific integrated circuit (ASIC), a digital signal processor (DSP), a field programmable gate array (FPGA), and conventional circuit components arranged to perform the recited functions.

The invention claimed is:

1. A liquid discharge apparatus comprising:
a platen configured to hold a medium;
a liquid discharge head configured to discharge a liquid onto the medium on the platen according to discharge instruction information containing information of a type of the platen designated from multiple platen types as a designated platen type;
an operation panel configured to display a selection operation screen in which a type of the platen is selectable from the multiple platen types as a selected platen type; and
circuitry configured to:
control the operation panel to display the selection operation screen on the operation panel;
determine whether the selected platen type matches a first specific platen type among the multiple platen types;
determine whether the designated platen type matches a second specific platen type different from the first specific platen type among the multiple platen types;
control the operation panel to display warning in response to a determination in which:
the selected platen type matches the first specific platen type, and
the designated platen type matches the second specific platen type; and
control the liquid discharge head to continue to discharge the liquid in response to a determination in which:
the selected platen type matches the first specific platen type, and
the designated platen type matches the second specific platen type.

2. The liquid discharge apparatus according to claim 1,
wherein the circuitry controls the operation panel to display warning in response to a determination in which:
the selected platen type does not match the first specific platen type, and
the designated platen type does not match the second specific platen type.

3. The liquid discharge apparatus according to claim 1,
the circuitry controls the liquid discharge head to continue to discharge the liquid in response to a determination in which:
the selected platen type does not match the first specific platen type, and
the designated platen type matches the second specific platen type.

4. The liquid discharge apparatus according to claim 1, further comprising:
a gap adjuster configured to adjust a gap between the liquid discharge head and the platen,
wherein the circuitry stops discharging the liquid until the gap adjuster adjusts the gap.

5. The liquid discharge apparatus according to claim 4,
wherein the circuitry stops discharging the liquid until the gap adjuster adjusts the gap at a certain time interval.

6. The liquid discharge apparatus according to claim 1,
wherein the circuitry determines whether the selected platen type matches the designated platen type in response to a determination in which the selected platen type does not match the first specific platen type, and
the circuitry does not determine whether the selected platen type matches the designated platen type in response to a determination in which the selected platen type matches the first specific platen type.

7. The liquid discharge apparatus according to claim 6,
wherein a gap adjuster includes a sensor configured to detect the platen, and
the sensor does not detect the platen in response to a determination in which the designated platen type does not match the second specific platen type.

8. A liquid discharge method comprising:
holding a medium on a platen;

discharging a liquid onto the medium on the platen according to discharge instruction information containing information of a type of the platen designated from multiple platen types as a designated platen type;

displaying a selection operation screen, on an operation panel, in which the type of the platen is selectable from the multiple platen types as a selected platen type; and controlling the operation panel to display the selection operation screen on the operation panel;

determining whether the selected platen type matches a first specific platen type among the multiple platen types;

determining whether the designated platen type matches a second specific platen type different from the first specific platen type among the multiple platen types;

controlling the operation panel to display warning in response to a determination in which:

the selected platen type matches the first specific platen type, and the designated platen type matches the second specific platen type; and controlling a liquid discharge head to continue to discharge the liquid in response to a determination in which:

the selected platen type matches the first specific platen type, and the designated platen type does not match the second specific platen type.

9. The liquid discharge method according to claim 8, further comprising:

controlling the operation panel to display warning in response to a determination in which:

the selected platen type does not match the first specific platen type, and the designated platen type does not match the second specific platen type.

10. The liquid discharge method according to claim 8, further comprising:

controlling the liquid discharge head to continue to discharge the liquid in response to a determination in which:

the selected platen type does not match the first specific platen type, and the designated platen type matches the second specific platen type.

11. The liquid discharge method according to claim 8, further comprising:

determining whether the selected platen type matches the designated platen type in response to a determination in which the selected platen type does not match the first specific platen type, and determining whether the selected platen type matches the designated platen type in response to a determination in which the selected platen type matches the first specific platen type.

* * * * *